US008202112B2

(12) United States Patent
Gabrielson

(10) Patent No.: US 8,202,112 B2
(45) Date of Patent: Jun. 19, 2012

(54) CONNECTOR SYSTEM AND SHORTING MEMBER

(75) Inventor: Psr Georg Gabrielson, Hässelby (SE)

(73) Assignee: FCI, Guyancourt (FR)

( * ) Notice: Subject to any disclaimer, the term of this patent is extended or adjusted under 35 U.S.C. 154(b) by 0 days.

(21) Appl. No.: 12/737,584

(22) PCT Filed: Jul. 28, 2008

(86) PCT No.: PCT/IB2008/054162
§ 371 (c)(1),
(2), (4) Date: Jan. 25, 2011

(87) PCT Pub. No.: WO2010/013095
PCT Pub. Date: Feb. 4, 2010

(65) Prior Publication Data

US 2011/0130033 A1 Jun. 2, 2011

(51) Int. Cl.
*H01R 31/08* (2006.01)

(52) U.S. Cl. ..... 439/507

(58) Field of Classification Search ..... 439/507, 439/188, 489
See application file for complete search history.

(56) References Cited

U.S. PATENT DOCUMENTS

| | | | | | |
|---|---|---|---|---|---|
| 3,653,498 | A | * | 4/1972 | Kisor | 206/728 |
| 4,179,173 | A | * | 12/1979 | Rise, III | 439/507 |
| 4,775,327 | A | | 10/1988 | Normann et al. | 439/140 |
| 5,263,872 | A | * | 11/1993 | Marpoe et al. | 439/188 |
| 5,277,608 | A | | 1/1994 | Oda | 439/188 |
| 5,562,486 | A | * | 10/1996 | Saijo et al. | 439/489 |
| 5,588,872 | A | * | 12/1996 | Fukuda | 439/489 |
| 5,647,754 | A | * | 7/1997 | Kohno | 439/188 |
| 5,803,756 | A | * | 9/1998 | Furutani et al. | 439/188 |
| 6,358,084 | B1 | * | 3/2002 | Rieger et al. | 439/507 |
| 6,746,275 | B2 | * | 6/2004 | Yamakawa et al. | 439/507 |
| 6,932,643 | B2 | * | 8/2005 | Bigotto | 439/507 |
| 7,351,084 | B2 | * | 4/2008 | Ohtaka et al. | 439/188 |
| 7,402,071 | B2 | * | 7/2008 | Ohtaka et al. | 439/357 |

FOREIGN PATENT DOCUMENTS

| | | | |
|---|---|---|---|
| EP | 0 615 312 | A2 | 9/1994 |
| EP | 0 665 454 | A1 | 8/1995 |
| EP | 1 367 678 | A2 | 12/2003 |
| WO | WO 00/46881 | | 8/2000 |

* cited by examiner

*Primary Examiner* — Tulsidas C Patel
*Assistant Examiner* — Vladimir Imas
(74) *Attorney, Agent, or Firm* — Harrington & Smith

(57) ABSTRACT

A connector system includes a first connector and a mating second connector. The first connector includes a housing, at least a first terminal and a plurality of further terminals. The second connector includes a housing, at least a second terminal configured for mating at least with the first terminal of the first connector. The second connector further includes at least one shorting member configured for interconnecting at least one set of at least two further terminals of the first connector.

20 Claims, 6 Drawing Sheets

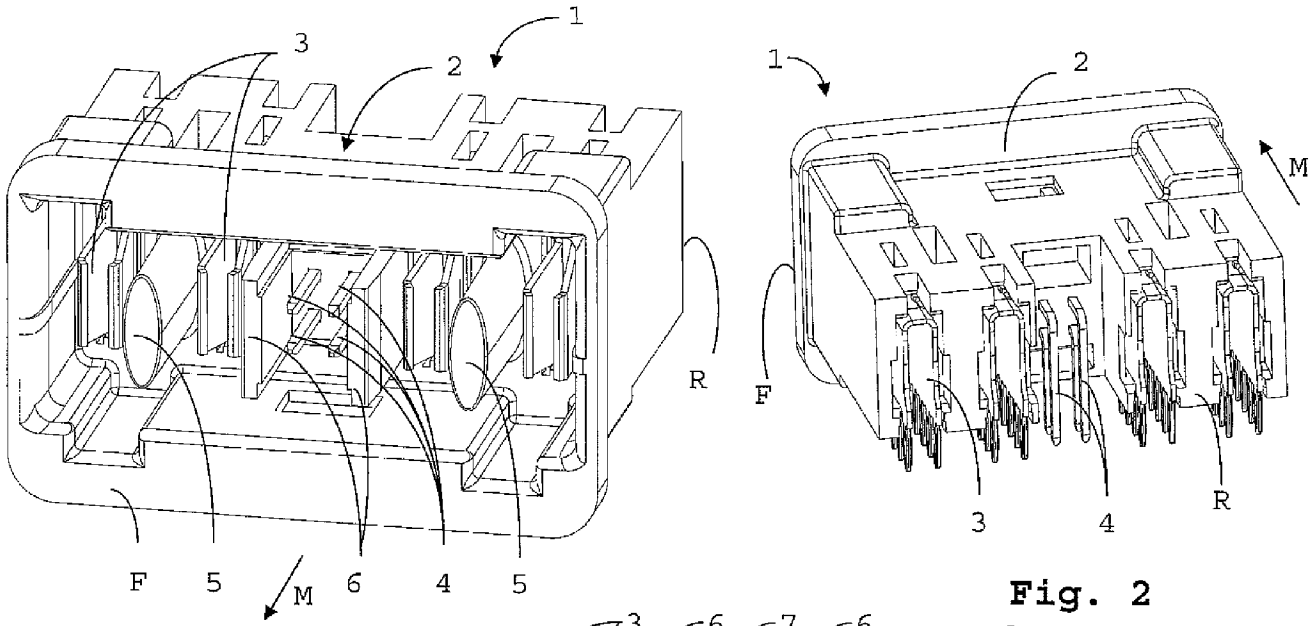
Fig. 1
Fig. 2
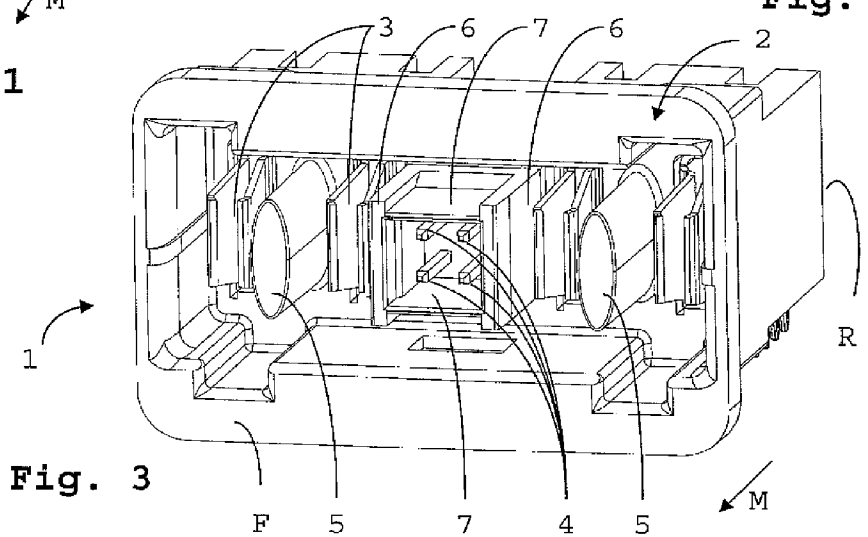
Fig. 3

CONNECTOR SYSTEM AND SHORTING MEMBER

FIELD OF THE INVENTION

The present invention relates to the field of connector systems for power supply purposes or signal transfer. More specifically, the invention relates to electrical connectors comprising safety features.

BACKGROUND OF THE INVENTION

The use of a connector and a counterpart, e.g. a cable connector and a board connector, is generally known for electrical power supply purposes or signal transfer via one or more terminals of the connector and counterpart. It may happen that the connection is activated, meaning that power or a signal is supplied to one or more of the terminals of the connector or the counterpart, at the time these are to be connected or disconnected. This may cause undesirable and potentially damaging or hazardous situations, e.g. having exposed power terminals and/or causing sparks when (dis-)connecting an electrical power connection, causing signal reflections on an open ended transmission line or exposing a laser light source in case of a disconnected optical connection. Such situations should therefore be prevented.

Further, identical connectors may be applied for performing a variety of purposes. As an example, some applications require a voltage supply of 24 Volts and others 48 Volts, which voltages can be supplied by the same connector. Since connecting a connector with a counterpart with which it should not be connected may damage equipment and possibly present a dangerous situation, such incorrect connection should be prevented, or at least activation of an inadvertent incorrect connection should be prevented.

It is an object of the invention to at least reduce or substantially eliminate the above-mentioned problems.

SUMMARY OF THE INVENTION

The present invention provides a connector system according to claim 1.

Thus, the connector system allows detecting the connection of the first and second connectors by detecting the shorting interconnection of the set of shorted further terminals of the first connector. Upon detecting such shorting interconnection the connection through the mated terminals of the first and second connectors may be activated. Mating or unmating the connectors while the connection is activated may thus be prevented.

The first and second connectors may be arranged for contacting a plurality of mating terminals for transmitting power and/or signals.

Here, the word "terminal" indicates an interconnection part for transmitting power and/or a signal, e.g. and electrically conductive terminal such as a pin or receptacle contact, or an optical terminal such as an optical fibre provided with a ferrule.

An electrical shorting member may e.g. comprise a shorting contact. An optical shorting member may e.g. comprise one or more reflective portions and/or or a light conduit, e.g. a fibre-optic loop.

It should be noted that the connector system and/or an associated apparatus may further usefully comprise a sensor being configured for detecting an interconnection between at least one set of at least two further terminals of the first connector and for providing a detection signal. The detection signal may indicate that the set of further terminals is interconnected, and thus that the first and second connectors are connected, or that the interconnection has been broken and the connection is open. Thus a check option is provided, which may be automated.

Further, the connector system and/or the apparatus may comprise a controller configured for operating a piece of equipment as a function of the detection signal of the sensor. In such an embodiment an operation may be performed automatically. The piece of equipment to be operated by the controller may usefully be a switch for activating the connection through the first terminal of the first connector and the second terminal of the second connector. In such embodiment, (dis-)connecting connectors with a continuously activated connection may be prevented substantially automatically.

The connector system according to claim 2 has the benefit that the interconnection is broken prior to the actual breaking of the connection the first terminal and the mating terminal. The (un-)mating of the connectors may therefore be detected and the connection be inactivated prior to making or breaking the connection such that potentially hazardous situations at disconnection are prevented.

Interconnecting of the further terminals by the shorting member may also directly function as closing a switch without requiring a sensor and/or controller.

For preventing incorrect activation of connections, the connector system of claim 3 may be provided. The shorting of different sets of further terminals may encode for different connectors and thus may provide information about whether or not a particular connection should be made, and when a particular connection is made whether or not it should be activated. Thus, the shorting member may be used as an electrical coding key.

The embodiment of claim 4 enables a realisation in a relatively small volume by the shorting member being arranged under a different relative angle of rotation with respect to the connector.

The shorting member may comprise a first portion and a second portion, wherein the first portion is configured for interconnecting at least one set of at least two further terminals of the first connector and wherein at least one of the connector and the second portion of the shorting member is provided with a latching arrangement configured for mounting the shorting member and the second connector to each other in at least one relative position. This construction facilitates manufacturing of at least the second connector of the connector system. The shorting member being mountable or mounted to the second connector by a latching arrangement, this substantially prevents inadvertent separation of the shorting member and the second connector, e.g. the shorting member falling out of the connector. Thus reliability of the assembled connector is improved and therewith safety is improved.

The embodiment of claim 5 allows adapting the relative position of the shorting member and the second connector. Thus, the second connector may be de-coded or re-coded, e.g. for connection in another apparatus or other configuration in general. The embodiment also facilitates replacement and/or repair.

The embodiment of claim 6 increases operating safety of the embodiment of claim 5. Preferably, only disassembly of one portion or part is required for facilitating the operation of adaptation while maintaining the aspect of preventing unintentional adaptation.

The connector system of claim 7 allows using the connector with different types of counterparts. It may also facilitate visual identification. Such a system may further provide redundancy with respect to coding connectors and therewith improve security.

Another aspect of the invention is a shorting member configured for use in the above-described connector system, according to claim 8.

The shorting member may be used for adapting an existing connector to fit the above-described connector system.

The embodiment of claim 10 allows repositioning of the shorting member, thus allowing re-use and repairs.

The first portion and the second portion of the shorting member may comprise different materials, wherein at least one of the first portion and the second portion is provided with a latching arrangement configured for attaching the first portion and the second portion to each other. This improves flexibility in designing the shorting member. It may also reduce costs. In particular when the first portion is a conductive portion and the second portion is an insulating portion security of the shorting member and thus of the entire connector system may be improved.

In another aspect of the invention, a connector system according to claim 13 or 14.

Thus a relatively safe and flexible connector system is provided, which allows electrical coding of the connector system, providing information about a correct mating of the first connector and the second connector. The shorting member being detachably attachable allows adapting the second connector at to a different situation.

The main parts of the connector system, being the first connector, the second connector and at least one shorting member, may be provided separately or as a kit of parts. An alternative kit of parts may comprise a second connector and at least one shorting member.

SHORT DESCRIPTION OF THE DRAWINGS

The invention will hereafter be fully explained with reference to the drawings showing embodiments of the invention by way of example. In the drawings, wherein like parts and elements are indicated with like reference signs, FIG. 1 is a perspective view from the mating side of a first connector of the assembly;

FIG. 2 is a perspective rear view of the connector of FIG. 1.

FIG. 3 is a perspective view from the mating side of an alternative embodiment of a first connector of the assembly;

DETAILED DESCRIPTION OF EMBODIMENTS

Figure 4A:
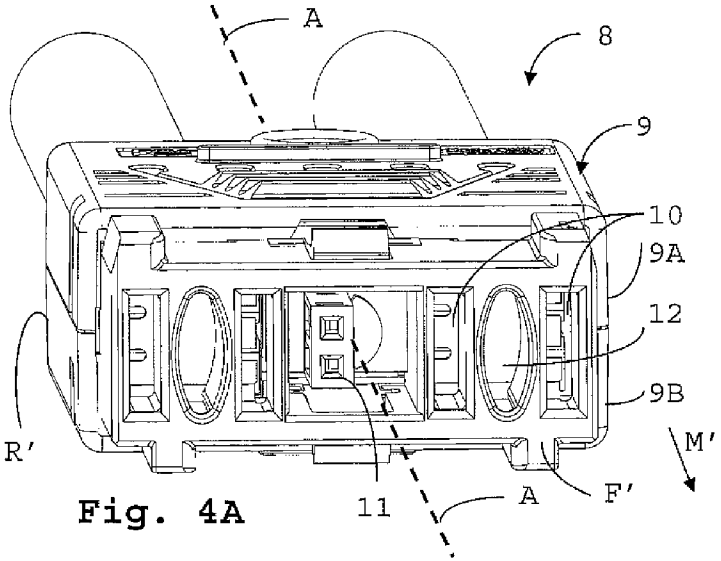
FIGS. 4A-4D are perspective views from the mating side of a second connector of the assembly, comprising a shorting member arranged in four different relative positions.

FIGS. 1 and 2 show an exemplary electrical connector 1 for connecting to a Printed Circuit Board (PCB), comprising an insulating housing 2 having a mating side F (FIG. 1) and a rear side R (FIG. 2). The connector 1 has a mating direction M extending in a direction from the rear side R towards the front side F of the housing 2. The connector 1 further comprises four power plug terminals 3 (two of which are indicated) and four coding terminals 4 extending in the mating direction M and arranged in a square relationship position. Walls 5 are arranged in between adjacent terminals 3 and walls 6 are arranged in between the terminals 3 and the coding terminals 4. The walls 5, 6, provide electric insulation of adjacent terminals 3, 4, and they extend in the mating direction M beyond the terminals 3, 4, for providing safety against accidental touching the terminals 3, 4. The walls 5 further assist in correctly aligning the connector 1 to an appropriate counterpart connector when mating the connectors with another.

FIG. 3 shows an embodiment of a connector which is substantially identical to the connector of FIG. 1, but wherein the walls 6 are strengthened with interconnecting supplemental walls 7, e.g. against sideways forces during mating of the connector 1 with a counterpart.

FIG. 4A shows a cable connector 8 for mating with the connector 1 of FIGS. 1-3. The connector 8 comprises an insulating housing 9, comprising two housing shells 9A and 9B. The cable connector 8 comprises four power receptacle terminals 10 (two of which are indicated) configured for mating with the plug terminals 3 of the board connector 1. The connector 8 further comprises a shorting member 11 configured for interconnecting a set of two coding terminals 4 of the connector 1. Different embodiments of the shorting member 11 will be discussed in some detail below.

The housing 9 has a rear side R' from which two cables extend (partially shown), a mating side F' and a mating direction M' extending in a direction from the rear side R' towards the mating side F' of the housing 9. A connector assembly comprising the connectors 1 and 8 thus has a mating direction M-M' with the directions M and M' substantially parallel to but in opposite direction. The housing 9 comprises apertures 12 for receiving the walls 5 of the board connector 1 and facilitating mating of the connectors 1, 8.

Figure 4B:
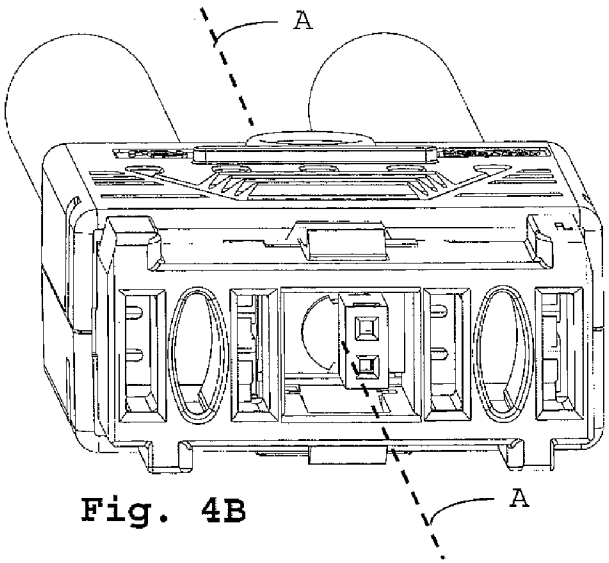
Figure 4C:
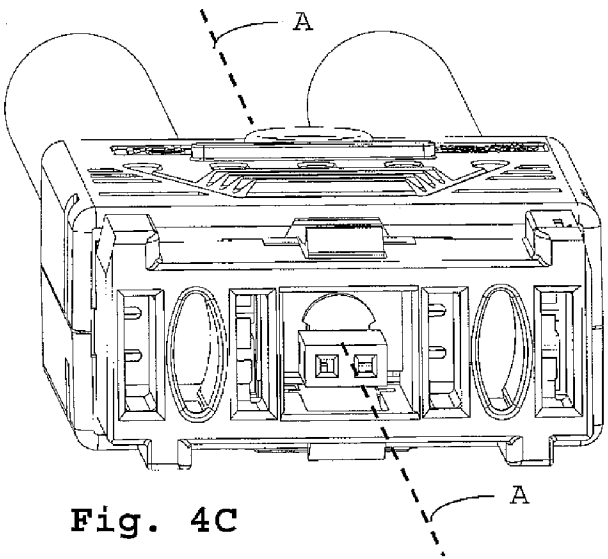
Figure 4D:
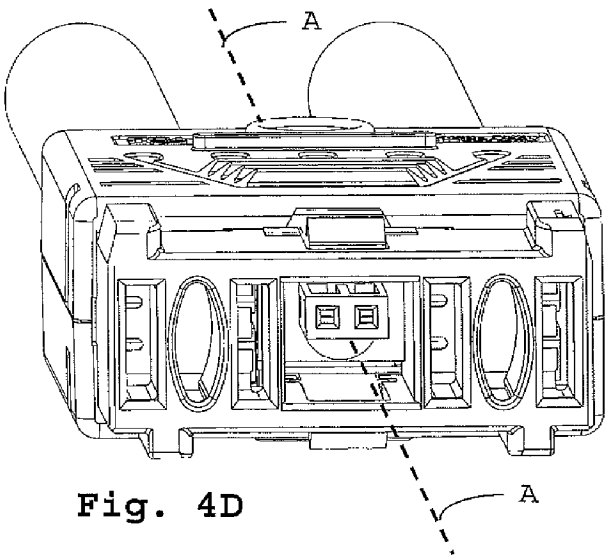

FIGS. 4B-4D show the connector 8 of FIG. 4A, the difference being that the shorting member 11 is mounted to (the housing 9 of) the connector 8 in various relative positions which differ with respect to a relative rotation about an axis A-A extending in the mating direction M' of the second connector 8 and thus with respect to the mating direction M-M' of the conductor assembly (1,8). As will be apparent to the skilled reader, in each of the four different positions shown (FIGS. 4A-4D), two different coding terminals 4 of connector 1 are interconnected by the shorting member 11 upon mating the connectors 1 and 8. Thus, the shorting member 11 is capable of acting as an electrical coding key. Different arrangements of the coding terminals 4 and corresponding arrangements of the shorting member may be envisioned, e.g. a twofold (mirror) symmetry (cf. FIG. 4A vs. FIG. 4B and FIG. 4C vs. FIG. 4D), a sixfold rotational symmetry and/or the shorting member 11 and electrical coding terminals 4 being arranged in another position on the connectors. In addition, the first connector 1 need not to comprise more than two coding terminals 4; a shorting member 11 may be used for simply signalling the presence of a counterconnector 8, e.g. for preventing (un-)mating while the connection is activated, without further coding functionality.

The shorting member 11 with the coding terminals 4 to be interconnected are located in a more forward position towards the mating side M' than the power terminals 3, such that upon connecting and disconnecting, respectively, the connectors 1, 8, the interconnection between the shorting member 11 and the coding terminals 4 is made later and broken earlier, respectively, than the connection between the terminals 3 and 10.

Figure 5:
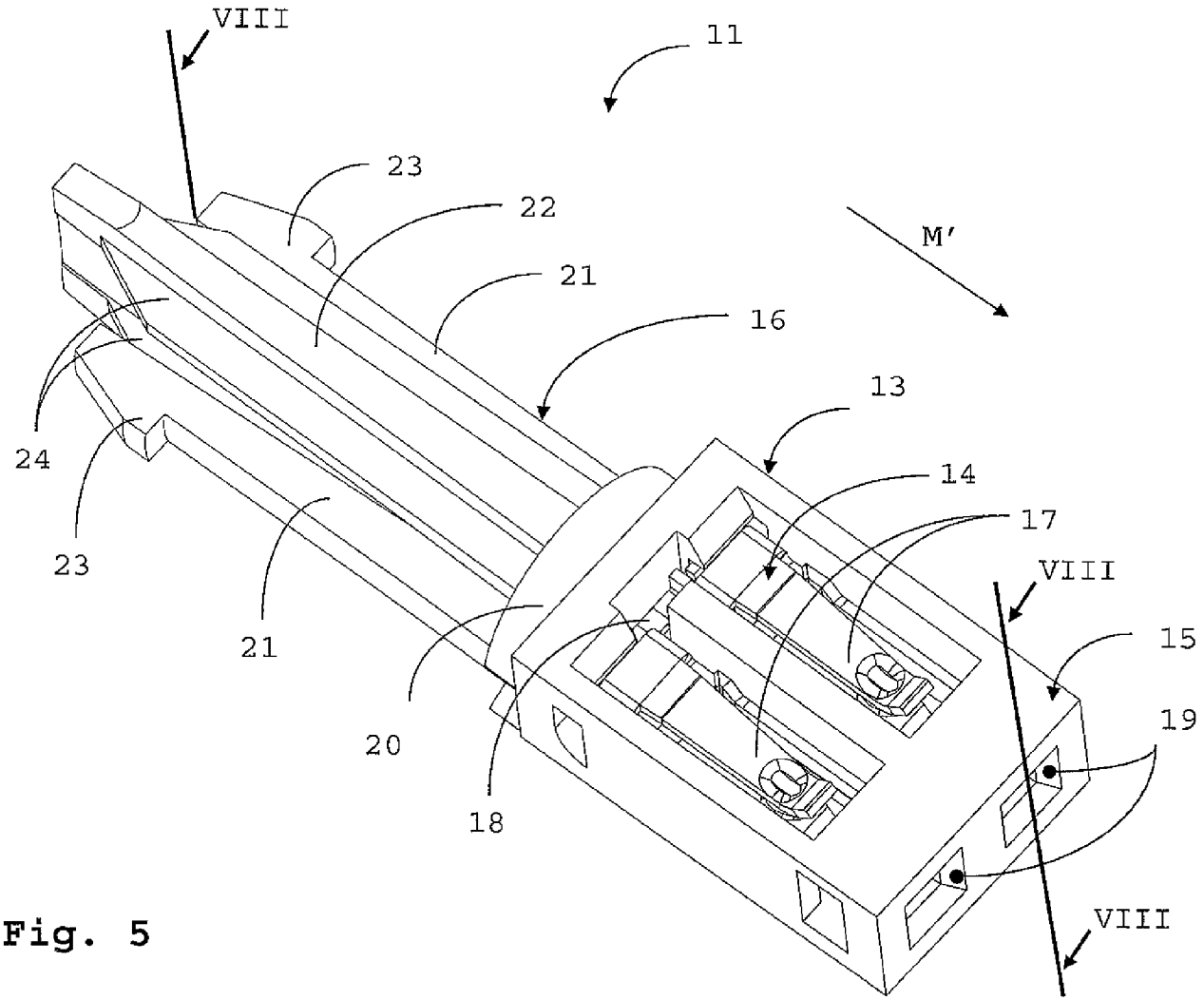
FIG. 5 is a perspective view of an embodiment of a shorting member.

FIG. 5 shows an embodiment of the shorting member 11. The shorting member is formed generally substantially similar to a mechanical coding key, which functionality it may also provide. The shorting member 11 is an electrical shorting member and comprises an insulating housing 13 and an electrically conductive shorting contact 14 accommodated within the housing 13. Here, the housing 13 is a unitary member which is shown more clearly in FIGS. 6A, 6B. The shorting contact 14 is shown more clearly in FIG. 7. The line VIII-VIII indicates a cross-sectional plane for the view of FIG. 8.

The shorting member 11 comprises a front mating portion 15 and a rear portion 16. The front mating portion 15 comprising the shorting contact 14 is configured for interconnecting a set of two coding terminals 4 of the connector 1. The rear portion 16 is configured for being mountable to (the housing 9 of) the connector 8. The shorting contact 14 comprises two receptacle terminals 17 conductively interconnected by a bridge 18. The receptacle terminals 17 are arranged in registry with two apertures 19 of the front portion of the housing 13, for receiving the terminals 4 of the board connector 1 and electrically interconnecting them.

The rear portion 16 of the shorting member 11 comprises a base portion 20 from which extend two legs 21 and a tongue 22 arranged in-between the legs 21. The legs 21 are arranged substantially opposite each other and each comprises a latching means 23 (e.g. barbs) arranged at or near their rear end, thus being configured for snap-locking into a suitably formed mounting portion of (the housing 9 of) the connector 8 such as an aperture or a recess. Preferably, the barbs 23 and the corresponding mounting portion of the connector 8 prevent detachment of shorting member 11 from the connector 8, preventing the shorting member from falling out etc. In a particularly useful assembly, however, the shorting member 11 is removable from the connector 8 when the legs 21 and/or the barbs 23 are made accessible intentionally. In the case of the shown connector 8, the shorting member 11 is inserted and snapped into a fitting channel within the housing 9, and the legs 21 and barbs 23 are only accessible upon (intentionally) separating the cover shells 9A, 9B. Such an arrangement facilitates mounting the shorting member 11 to the connector 8 and allows subsequent removal/re-orienting thereof while substantially assisting preventing accidental detaching and/or re-orientation of the shorting member 11 with respect to the connector 8.

The tongue 22 of the shorting member 11 comprises ribs 24. The tongue 22 and ribs 24 protect the legs 21 from excessive bending stress and from sideways and/or rotary forces which may occur e.g. during mounting of the shorting member 11 to the connector 8 and/or during connecting the connectors 1 and 8. Moreover, the ribs 24 strengthen the tongue 22 itself. Thus the shorting member is relatively strong and its position and/or its mechanical functionality may be relatively reliable.

Figure 6B:
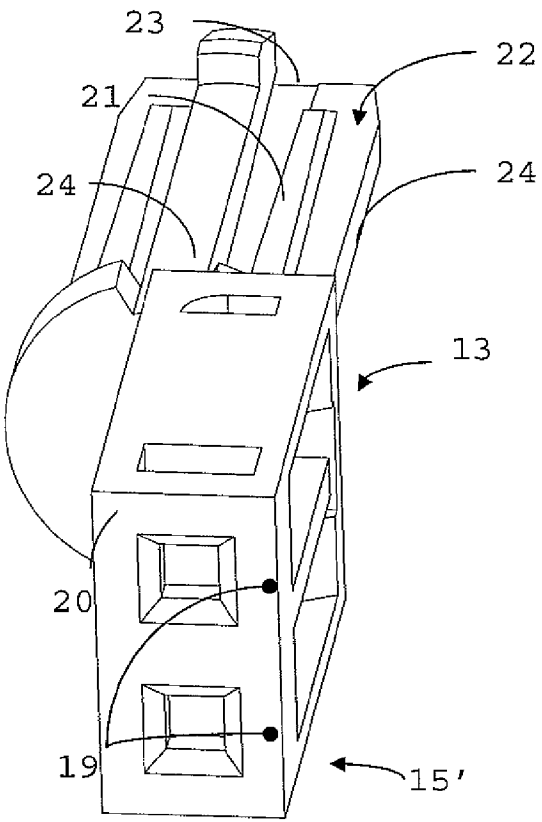
FIGS. 6A and 6B are perspective views of an insulating portion of the shorting member of FIG. 5.
Figure 6A:
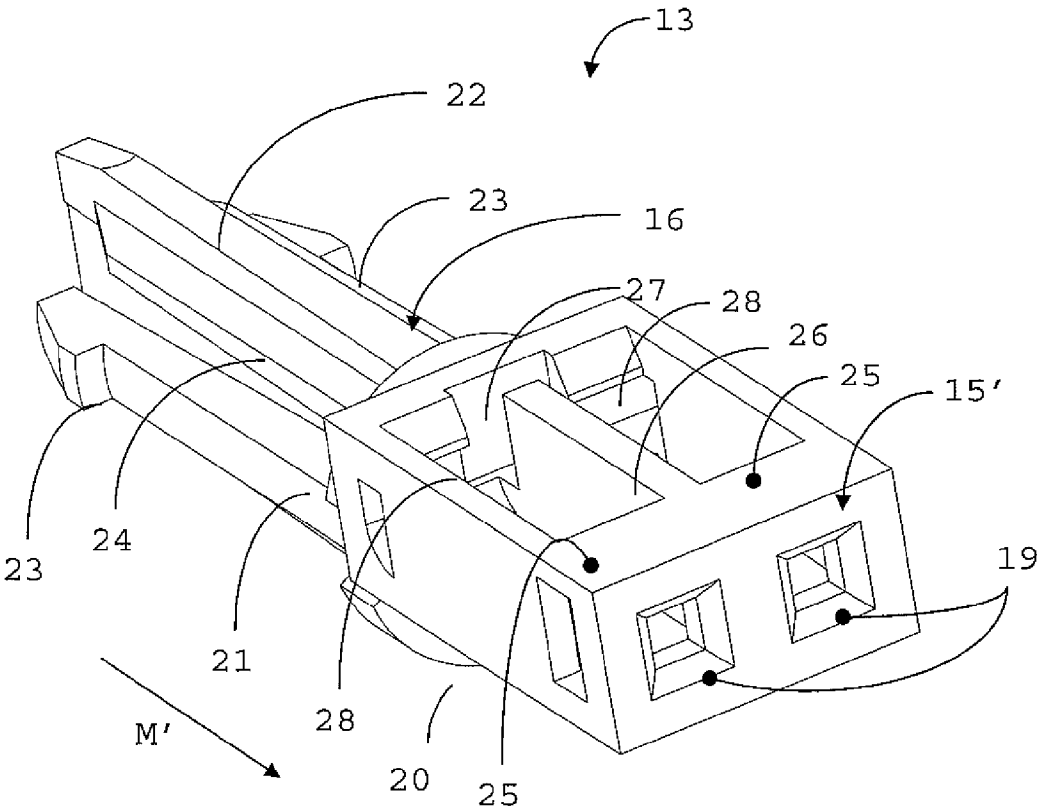

The front portion 15 of the shorting member housing 13, shown in FIGS. 5-6B, comprises two cavities 25 in communication with the apertures 19 and separated by a partition wall 26, for receiving the receptacle terminals 17. The separation wall 26 provides mechanical stability to the front portion 15' and assists mounting of the shorting contact 14 into the front portion 15'. The cavities 25 are delimited by a rear wall 27, which is attached to the base portion 20 and which comprises latch ridges 28.

Figure 7:
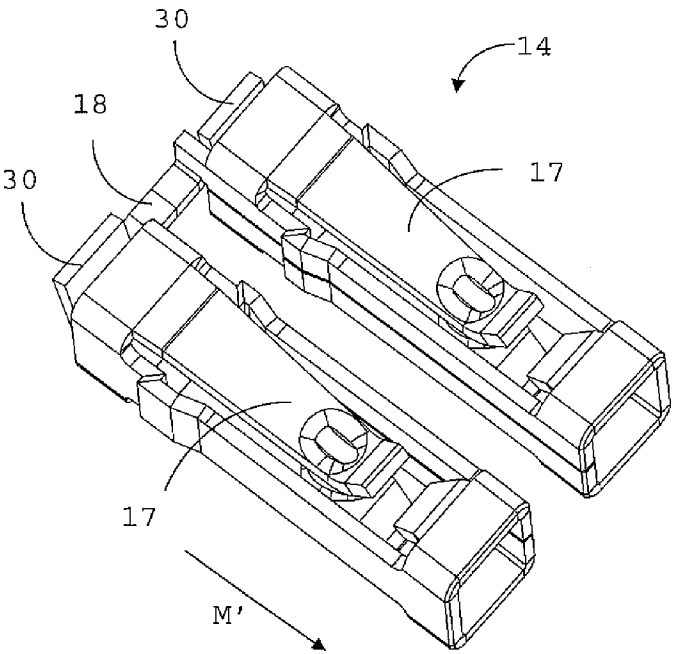
FIG. 7 is a perspective view of a conductive portion of the shorting member of FIG. 5.

FIG. 7 shows the shorting contact 14 of the shorting member 11 of FIG. 5. It is a female jumper-style contact for electrically shorting two male terminals, such as terminals 4. The shorting contact may be manufactured from a piece of sheet material by stamping and folding. At the rear side, the shorting contact 14 is provided with latching portion 30.

Figure 8:
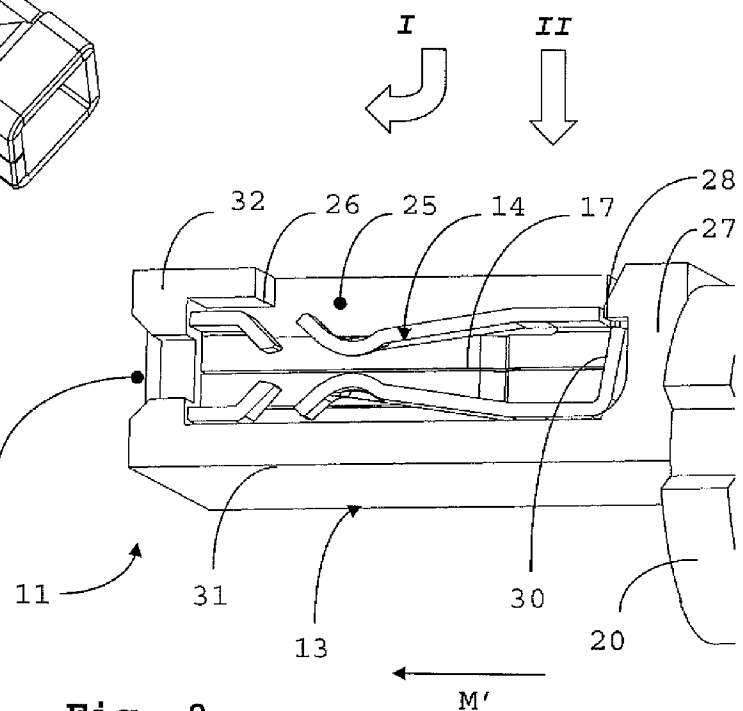
FIG. 8 illustrates a method of fabricating the shorting member of FIG. 4.

FIG. 8 is a cross-sectional perspective view of the shorting member 11 along the line VIII-VIII in FIG. 5. In FIG. 8 may be seen that the cavity 25 of the housing 13 extends towards the aperture 19 between a side wall 31 and a ridge 32. The open arrows I and II in FIG. 8 illustrate a method of manufacturing a shorting member 11 by inserting the shorting contact 14 into the housing 13 and behind the ridge 32, and sliding or pushing in the mating direction M'. The contact 14 is then pushed down into the housing 13, possibly guided by the slanted surfaces of the latches 28 and 30, such that the latches 30 snap behind the latch ridges 28 and the shorting contact 14 is fixed to the housing 13. The assembly may be performed in separate steps or in one fluid motion.

Figure 10:
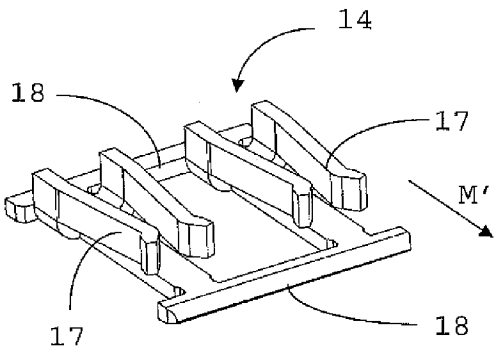
FIG. 10 is a perspective view of a conductive portion of the shorting member of FIG. 9.
Figure 11:
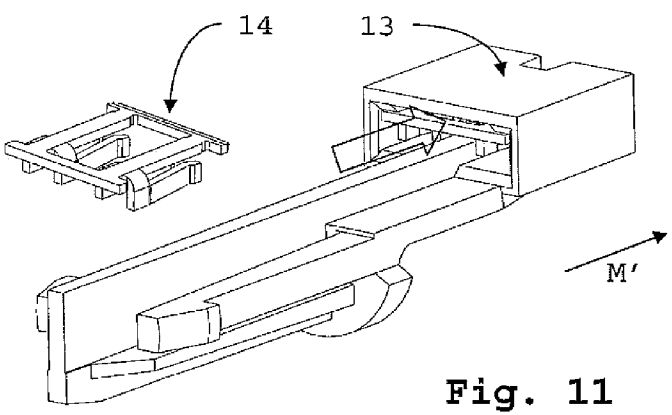
FIG. 11 illustrates a method of fabricating the shorting member of FIG. 9.
Figure 9:
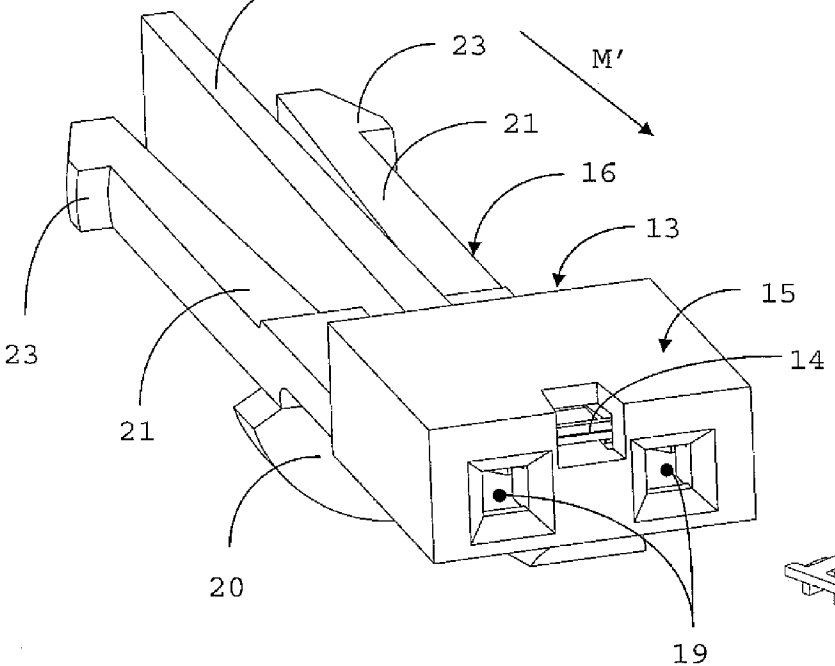
FIG. 9 is a perspective view of an alternative embodiment of a shorting member.

FIGS. 9-11 show another embodiment of a shorting member 11. FIG. 9 shows the shorting member 11, FIG. 10 shows a shorting contact 14 for use with the shorting member 11 of FIG. 9 and FIG. 11 illustrates manufacturing of the shorting member 11 by assembling the housing 13 and the shorting contact 14. The shorting member 11 of FIG. 9 closely resembles that of FIG. 5 and has substantially identical functionality. The shorting contact 14 of FIG. 10 is another type of female jumper contact but operates substantially identically, having two receptacle portions 17 interconnected by bridges 18. This type of contact is smaller than the type of the type of contact 14 of FIG. 5, thus it may reduce costs.

The shorting member 11 is manufactured by inserting the shorting contact 14 into the front portion 15 of the shorting member housing 13 from the rear side in the mating direction M', as indicated by the open arrow in FIG. 11. To allow this assembling method, the width of the tongue 22 is reduced at least near the front portion 15 of the shorting member housing 13. In the shown embodiment, width of the tongue is reduced along its full length with respect to the tongue 22 of FIGS. 5-7. The shorting contact 14 may be held or fixed to the housing 13 by a friction fit, by latching features (not shown), or by the cooperation between the shorting member housing 13 and the connector housing 9, thus being held generally in place by the locking action of the barbs 23 onto the connector housing 9.

Although a shorting member 11 may be one integral member, constructing the shorting member 11 of separate parts 13, 14 has the benefit that the parts 13 and 14 can be made from separate materials, allowing optimisation of materials, cost factors, etc. Moreover, the shorting member housing 13 may be formed substantially as a mechanical coding key, such as shown here, and thus it may also be used without being provided with the shorting contact 14, saving costs.

As indicated, (the housing part 13 of) the shown shorting members 11 (FIGS. 5-8; 9-11) are usable as a mechanical coding key 11 easy distinguishable by a user. To allow quick verification whether a given coding key 11 is (also) configured for electrical interconnection, the shorting contacts 14 are made visible from the outside of the shorting member housings 13, also when the key is mounted into a connector.

In the shown embodiments the shorting contact 14 is a jumper-style contact which merely interconnects two coding terminals. The shorting member may also be configured for interconnecting more than one pair of terminals independently in parallel, e.g. comprising a plurality of shorting contacts, and/or for interconnecting more than two terminals at one time, e.g. interconnecting three or four terminals with a single appropriately formed shorting contact.

It should be noted that the invention is not restricted to the above described embodiments which can be varied in a number of ways within the scope of the claims. For instance, the connectors may be any type of matable connector.

In the shown embodiments the shorting contact 14 is a female, receptacle contact and the coding terminals 4 are male contact terminal plugs. However, it will be apparent to the skilled person that the opposite is also within the scope of the invention: the contact terminals may comprise receptacle terminals and the shorting interconnection may comprise plug contacts. Mixed arrangements of plugs and receptacles within the shorting member are also possible, which may also provide for mechanical coding.

Further, the coding arrangement may comprise an optical coding arrangement with the coding key comprising an optical interconnection device such as a light conduit, e.g. a fibre-optic loop interconnecting two optical terminals each connected to an optical source and/or a detector, e.g. an LED and a photodiode.

Combinations of optical and electrical systems are equally conceivable, e.g. an optical shorting member for use with an electrical connector system or the other way around.

The invention claimed is:

1. Connector system comprising a first connector and a mating second connector, wherein the first connector comprises at least a first terminal and a plurality of further terminals;

wherein the second connector comprises at least a second terminal configured for mating at least with the first terminal of the first connector and at least one shorting member configured for electrically interconnecting at least two further terminals of the first connector, wherein the shorting member is configured as a mechanical coding key comprising an insulating housing and an electrically conductive shorting contact, where the insulating housing is configured to be connected to the second connector at different locations.

2. Connector system according to claim 1, wherein the shorting member and the further terminals to be interconnected are arranged with respect to at least the first terminal of the first connector and the second terminal of the second connector such that upon connecting and disconnecting, respectively, the first connector and the second connector, the interconnection between the shorting member and the further terminals is made later and broken earlier, respectively, than the connection between the first terminal and the second terminal.

3. Connector system comprising a first connector and a mating second connector, wherein the first connector comprises at least a first terminal and a plurality of further terminals;

wherein the second connector comprises at least a second terminal configured for mating at least with the first terminal of the first connector and at least one shorting member configured for electrically interconnecting at least two further terminals of the first connector wherein the shorting member is configured for being matable with less than all and different ones of the further terminals of the first connector in a plurality of different relative positions.

4. Connector system according to claim 3, wherein the shorting member and the second connector are configured for being mounted to each other in a plurality of relative positions which differ with respect to a relative rotation about an axis (A) extending in a mating direction (M-M') of the first connector and the second connector.

5. Connector system according to claim 1, wherein the second connector and the shorting member are configured so that the shorting member is detachably mounted on the second connector.

6. Connector system according to claim 5, wherein the shorting member is detachable only after at least partial disassembly of at least one of the second connector and the shorting member.

7. Shorting member configured for use in a connector system according to claim 1, where the shorting member comprises a first portion and a second portion, wherein the first portion is configured for electrically interconnecting at least two further terminals of the first connector and wherein the second portion is configured for being mounted to the second connector in at least one relative position.

8. Shorting member according to claim 7, wherein the second portion is provided with attachment means for detachably mounting the shorting member and the second connector to each other.

9. First connector configured for a connector system according to claim 1, comprising a housing and at least one first terminal and the plurality of further terminals;

wherein the further terminals are arranged in a rotationally symmetric pattern for being interconnectable by the shorting member further comprising a first portion and a second portion, wherein the first portion is configured for electrically interconnecting at least two further terminals of the first connector and wherein the second portion is configured for being mounted to the second connector in at least one relative position.

10. Second connector configured for a connector system according to claim 1, comprising a housing and at least one second terminal for mating with the first terminal of the first connector of the connector system, and further comprising the shorting member comprising a first portion and a second portion, wherein the first portion is configured for electrically interconnecting at least two further terminals of the first connector and wherein the second portion is configured for being mounted to the second connector in at least one relative position.

11. Connector system comprising a first connector and a mating second connector, wherein the first connector comprises a housing and at least a first terminal and a plurality of coding terminals;

wherein the second connector comprises a housing, at least a second terminal configured for mating with at least the first terminal of the first connector and at least one shorting member configured for electrically interconnecting at least one set of at least two coding terminals of the first connector and wherein the shorting member is configured for being matable with the coding terminals of the first connector in a plurality of different locations relative to the first connector.

12. Connector system comprising a first connector and a mating second connector, wherein the first connector comprises a housing and at least a first terminal and a plurality of coding terminals;

wherein the second connector comprises a housing, at least a second terminal configured for mating at least the first terminal of the first connector and at least one shorting member configured for electrically interconnecting at least one set of at least two coding terminals of the first connector, wherein the shorting member and the second connector are configured for being detachably mounted on each other in a plurality of relative positions which differ with respect to a relative rotation about an axis (A) extending in a mating direction (M-M') of the first connector and the second connector.

13. An electrical connector comprising:

a housing;

at least one first terminal connected to the housing, where the at least one first terminal is configured for mating with at least one terminal of a mating connector; and at least one shorting member configured for electrically interconnecting at least two terminals of the mating connector, where the shorting member is configured as a mechanical coding key comprising an insulating housing and an electrically conductive shorting contact, where the insulating housing of the shorting member is configured to be connected to the housing of the electrical connector at different orientations.

14. An electrical connector as in claim 13 where the housing comprises a hole, where a rear portion of the insulating housing of the shorting member is configured to be inserted in the hole at different angular positions to provide the different orientations.

15. An electrical connector as in claim 14 where the rear portion of the insulating housing of the shorting member comprises deflectable legs to snap-lock in the hole.

16. An electrical connector as in claim 14 where the insulating housing of the shorting member comprises a front mating portion with the shorting contact therein, where the front mating portion is at least partially offset from a centerline axis of the rear portion.

17. An electrical connector as in claim 14 where the front mating portion comprises two cavities each having a separate front aperture into the cavities at a front side of the front mating portion.

18. An electrical connector comprising:

a housing;

at least one first terminal connected to the housing, where the at least one first terminal is configured for mating with at least one terminal of a mating connector; and a shorting member connected to the housing, where the shorting-member is connectable to the housing at one of a plurality of different relative positions on the housing, where the shorting member comprises an insulating housing and an electrically conductive shorting contact, where the shorting contact is configured to mate with less than all and different ones of terminals of a mating connector in a plurality of different relative positions, where the terminals of the mating connector, which the shorting contact is able to mate with, is dependent upon in which one of the plurality of different relative positions the shorting member is connected to the housing.

19. An electrical connector as in claim 18 where the housing comprises a hole, where a rear portion of the insulating housing of the shorting member is configured to be inserted in the hole at different angular positions to provide the different relative positions, and where the rear portion of the insulating housing of the shorting member comprises deflectable legs to snap-lock in the hole.

20. An electrical connector as in claim 18 where the housing comprises a hole, where a rear portion of the insulating housing of the shorting member is configured to be inserted in the hole at different angular positions to provide the different relative positions, and where the insulating housing of the shorting member comprises a front mating portion with the shorting contact therein, where the front mating portion is at least partially offset from a centerline axis of the rear portion.

* * * * *